United States Patent [19]

Ottestad

[11] Patent Number: 4,892,359

[45] Date of Patent: Jan. 9, 1990

[54] BUCKET SYSTEM WITH PERCUSSIVE PENETRATION MEMBER

[76] Inventor: Jack B. Ottestad, 1442 Muirlands Dr., La Jolla, Calif. 92037

[21] Appl. No.: 359,484

[22] Filed: May 31, 1989

Related U.S. Application Data

[63] Continuation-in-part of Ser. No. 205,266, Jun. 10, 1988.

[51] Int. Cl.[4] ..... E02F 3/32; E21C 3/04

[52] U.S. Cl. ..... 299/37; 37/118 R; 37/DIG. 18; 37/141 R; 299/69

[58] Field of Search ..... 37/141 T, 142 R, 141 R; 299/37, 38, 62, 69, 94

[56] References Cited

U.S. PATENT DOCUMENTS

| | | | |
|---|---|---|---|
| 3,065,557 | 11/1962 | Pewthers | 37/DIG. 18 X |
| 3,375,596 | 4/1968 | Bacquie | 299/37 X |
| 3,795,070 | 3/1974 | Bronson et al. | 299/37 X |
| 3,828,951 | 8/1974 | Fleming | 37/141 T X |

FOREIGN PATENT DOCUMENTS

| | | | |
|---|---|---|---|
| 92888 | 4/1957 | Norway | 37/141 R |
| 977596 | 11/1982 | U.S.S.R. | 37/DIG. 18 |

*Primary Examiner*—Randolph A. Reese
*Assistant Examiner*—Arlen L. Olsen
*Attorney, Agent, or Firm*—Donald D. Mon

[57] ABSTRACT

A bucket system which includes a bucket having a bottom with a digging edge. An impact-type penetration member projects beyond the digging edge to penetrate the surface of a body being excavated. The free edge of the penetration member is continuous and is at least as long as the bucket is wide. Bearing surfaces and restraint surfaces enable the penetration member to be driven by an impact member with reduced wear, and with the ability to respond to irregularities in the surface being penetrated. Preferably the penetration member includes a pair of deflector wings spaced apart farther than the sides of the bucket.

11 Claims, 5 Drawing Sheets

BUCKET SYSTEM WITH PERCUSSIVE PENETRATION MEMBER

CROSS-REFERENCE TO OTHER PATENT APPLICATION

This is a continuation-in-part of applicant's co-pending patent application Ser. No. 07/205,266 filed June 10, 1988 entitled "Bucket System With Percussive Penetration Member".

FIELD OF THE INVENTION

This invention relates to buckets of the type used for excavation, for demolition, and for mining to penetrate and fragment a body, and to collect the released body material.

BACKGROUND OF THE INVENTION

In the field of demolition, excavation and mining, it is common practice to utilize impact hammers to drive a spade or a pick into the body to separate a portion of it for removal. An impact hammer of this general type is shown in Ottestad U.S. Pat. No. 3,363,512, issued Jan. 16, 1968, which exemplifies a broad range of hydraulically or pneumatically powered hammers. These are sometimes hand held, but more frequently are mounted to a boom for support and manipulation.

These are effective devices validated by long usage. However, they do have significant limitations. One is that very often they simply make a hole. While this does weaken the body and can separate some of it for removal, still getting the material into a bucket usually requires the bucket itself to be used as an impact means. Known buckets are poorly suited to this type of usage.

Another mode of operation is even more severe on the bucket. In this mode, the bucket may or may not have teeth on its digging edge, and that edge is slammed into the body, hopefully to release some material. The problem arises when, as often happens, the bucket does little good on the first blow, and the blow must be repeated. The bucket is raised and slammed down again, but generally it strikes at a different place. This is rarely better than the first blow. The system is simply very inefficient.

Furthermore, buckets are open-faced structures with boundary walls, one of which has the digging edge. Unless they are made unduly heavy, this class of impact to which the bucket is subjected soon causes undesirable deterioration. Often the blow is delivered at a corner, which transmits an eccentric load that must be resisted by even heavier equipment such as larger bearings and cylinders.

As a consequence, equipment utilizing a bucket as part of the release segment of the mining, demolition, or excavation process, is generally inefficient and too large.

It is an object of this invention to provide a bucket with impact means to separate the material without requiring the entire bucket to be involved in the separation part of the process.

This is not a simple objective to attain. For example, it is not optimal to cause the entire bucket to be part of the impact movement, only in part for the reasons described above. Of even greater consequence is the fact that there is a critical relationship between the mass of the driver of the impact hammer itself, and of the total mass to be driven. A light-weight hammer striking a heavy bucket has little effect - much like trying to drive a heavy spike with a tack hammer. Thus, to drive the entire bucket as an impact device would require an impact hammer of excessive mass and bulk. It should be remembered that these buckets are intended to be manipulated, usually at the end of a fairly long boom and often in close quarters. The concurrent requirements of a heavy bucket and a heavy hammer frustrate the construction of a system of useful size.

This invention is able to utilize a conventional bucket, and a sensibly sized impact hammer, by decoupling the impact portion of the hammer from the bucket. In turn, it is necessary to fit the impact hammer into a sensible envelope, and in such a way that it can function to best advantage. While doing so, it is necessary to keep in mind that the effectiveness of an impact blow decreases as the projected cross-section area of the tool increases. Thus, an objective is to keep the projected area small, at least near the working end. This objective is frustrated by the reduced resistance to buckling that results from reducing the cross-section of a long blade which is to exert the impact.

It is an object of this invention to provide the bucket with an impact tool having an optimally small projected area, and which is supported in such a way as to resist binding and buckling forces without excessive binding resistance.

In tests, the bucket of this invention has gone through heavy concrete structures at rates at least several times those which are attainable with known buckets. It has dug at quite rapid rates through deposits such as caliche, which previously known backhoes could not effectively penetrate at all.

BRIEF DESCRIPTION OF THE INVENTION

A bucket according to this invention includes sidewalls, and a base wall having a digging edge. An impact hammer is mounted to the bucket adjacent to the base wall. A penetration member is driven by the hammer. It projects beyond the digging edge as a blade to penetrate and separate portions of the body to be gathered by the bucket.

According to a preferred but optional feature of the invention, the penetration member has on its narrower edge a pair of opposite boundary surfaces which taper toward one another in such a way as to extend away from one another when the penetration member is driven into the body. In addition it has a pair of broad flat bearing surfaces on opposite sides, between the boundary surfaces, which support the impact member against buckling.

According to yet another preferred but optional feature of the invention, a driving base supports the penetration member, which itself directly receives the blow from the hammer, whereby to support the penetration member against eccentric movement during its driving motion.

According to still another preferred but optional feature of the invention, the impacting edge of the penetration member is curved or tapered so as to prevent an initially small impact area.

According to another preferred but optional feature of the invention, the penetration member is provided with deflector means which rise above the level of the central impacting edge and fragment the body and deflect material into the bucket.

The above and other features of this invention will be fully understood from the following detailed description and the accompanying drawings, in which:

DETAILED DESCRIPTION OF THE INVENTION

Figure 1:
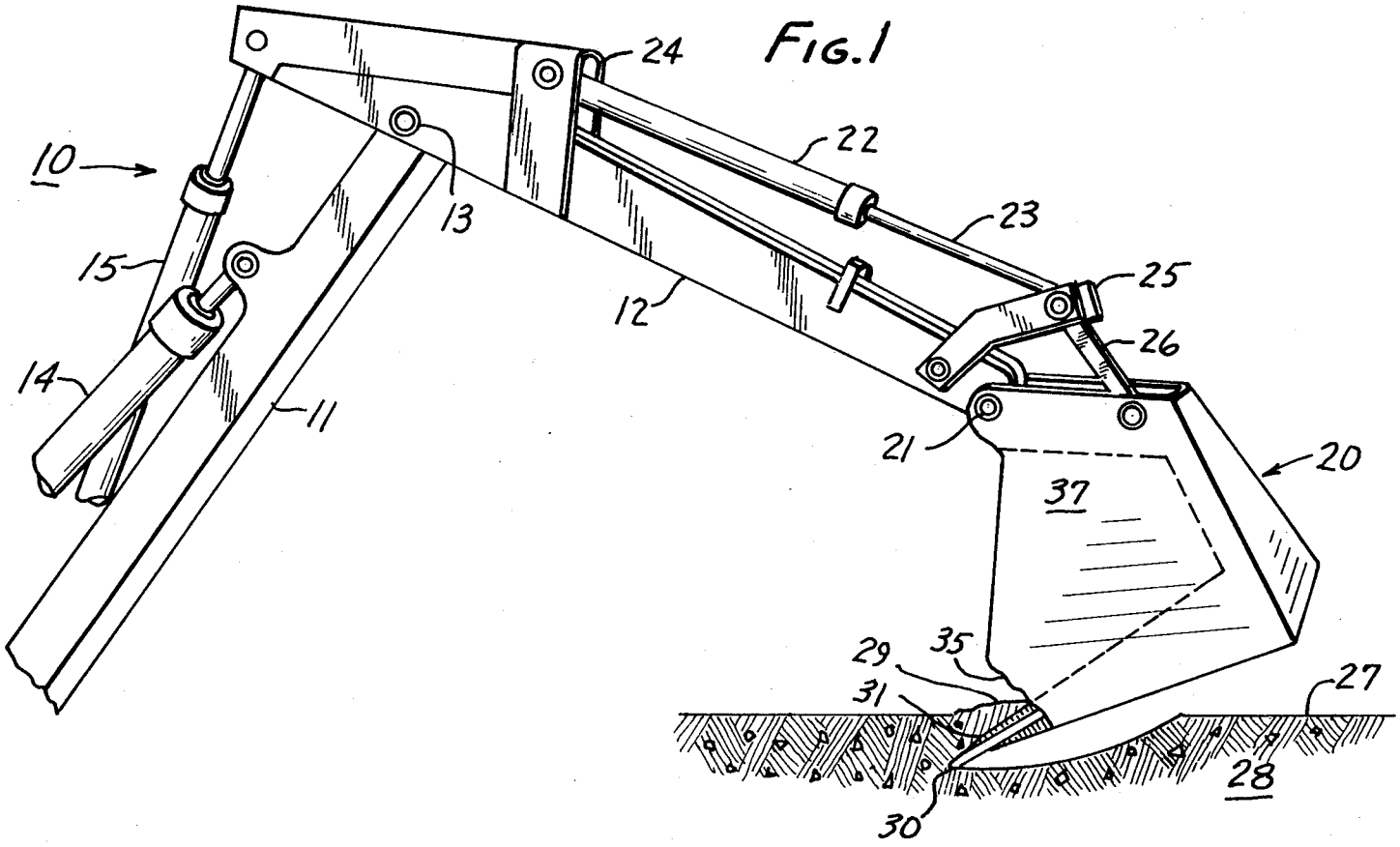
FIG. 1 is a perspective view of a backhoe boom manipulating a bucket according to this invention.
Figure 2:
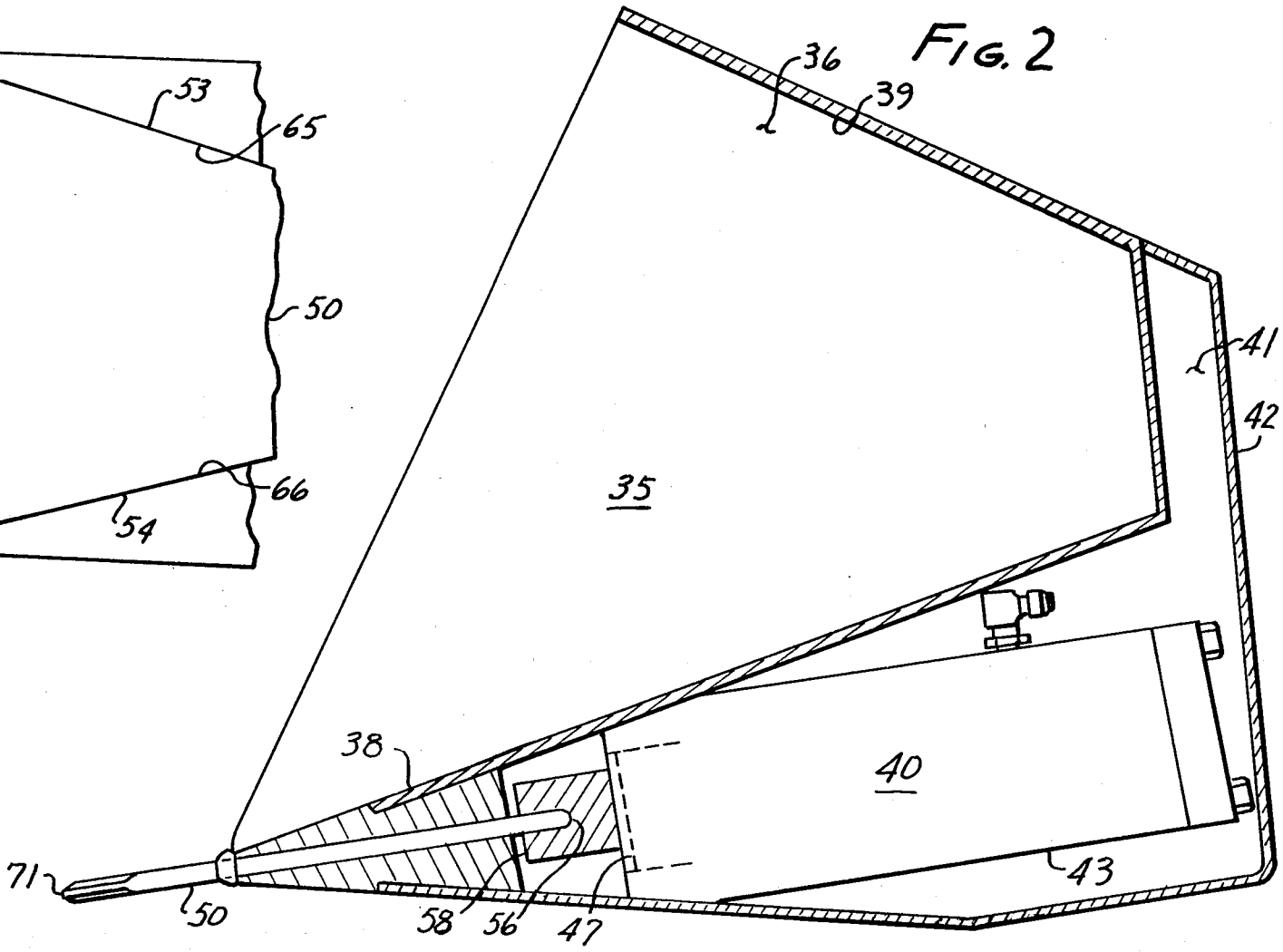
FIG. 2 is an axial vertical cross-section of the bucket of FIG. 1.
Figure 3:
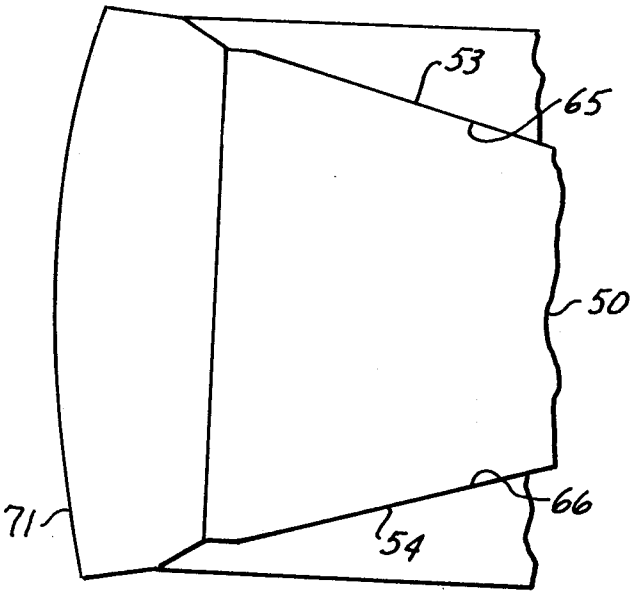
FIG. 3 is a fragmentary view of part of the impact hammer of FIG. 1.

FIG. 1 shows a conventional reticulated backhoe boom 10 which is usually attached to a vehicle (not shown). Links 11, 12 of the boom are joined by hinge pin 13. Hydraulic cylinder/piston assembly 14 manipulates link 11 relative to the vehicle. Hydraulic cylinder/piston assembly 15 manipulates link 12 relative to link 11.

Impact bucket 20 is joined to link 12 by hinge pin 21. A hydraulic cylinder/piston assembly 22 with a rod 23 is interposed between a shackle 24 on link 12 and a hinge plate 25. Link 26 joins hinge plate 25 to the bucket at a hinge pin 26a. Persons skilled in the art will recognize that the device shown can be used as a backhoe by controlling the movements of the three assemblies.

The intended purpose of this assembly is to dig into an exposed working face 27 of a body 28, and to remove material 29 from it. This action is shown in FIG. 1, where a penetration member 30 is shown digging ahead of the digging edge 31 of the bucket.

The bucket has a cavity 35 with sidewalls 36, 37, and a base wall 38. The base wall extends to a top wall 39 and carries digging edge 31.

Impact mechanism 40 is disposed in a chamber 41 formed by a rigid housing 42 below the base wall. The workings 43 of the impact mechanism are only schematically shown, because their specific construction is not important to the invention. Reference may be made to said Ottestad U.S. Pat. No. 3,363,512 for details of a suitable set of workings. This patent is incorporated herein in its entirety for its showing of such workings. Hydraulic controls and lines will be provided to these workings and to all of the cylinder/piston assemblies in a conventional way.

The workings are mounted to the bucket by bolts, weldments, or otherwise. The workings include a striker 45 which is axially driven as shown by arrow 46. It has a flat striker face 47 (FIGS. 4 and 5) which usually will be circular and will have a substantial flat area. Its function is to deliver a blow to drive penetration member 30 in the direction away from the digging edge of the bucket.

Successive percussive blows by the striker drive the penetration member into the body of material, releasing some of it. The bucket is simultaneously pulled along in a digging manner to collect and remove the loosened material. Notice that the bucket itself is not used or manipulated to deliver any blow. All blows are delivered by the penetration member, which is decoupled from the bucket itself. As a consequence, the impacting blows are driven repetitively in the same alignment, and the bucket need not be designed to resist or to exert heavy blows.

Impact mechanisms of the Ottestad type deliver strong blows as the consequence of a surprisingly small length of striker travel. It is common for blows of 500 foot pounds of energy to be delivered by strikers traveling at the velocity of 40 feet per second in a total striker travel of only about two inches. These strong blows must be transmitted to a penetration member of optimally small projected area (the lateral cross-section). Still, this must be accomplished without buckling the member. Also it should be recalled that contact of the penetration member with a working face can be a random event in the sense that the blow may be delivered at the center of the member or at its edge, however the situation arises. Thus it is necessary to provide for accommodation of eccentric loads so that the penetration member will not jam.

These objectives are attained with the use of a flat blade 50 as part of the penetration member. It has a pair of largearea flat bearing surfaces 51, 52 on the top and bottom, and a pair of boundary surfaces 53,54 preferably flat, on each side. Boundary surfaces 53 and 54 taper toward each other as they extend away from the digging edge.

Base end 56 of the blade is preferably rounded, and fits snugly in a groove 57 in a driving base 58. Driving base 58 is a strong member with a flat face 59 that receives blows from the striker and of the driving base have a substantial area facing one another, so the tendency of the blow is to keep face 59 normal to the central driving axis and to distribute the impactforce over a substantial area.

Figure 4:
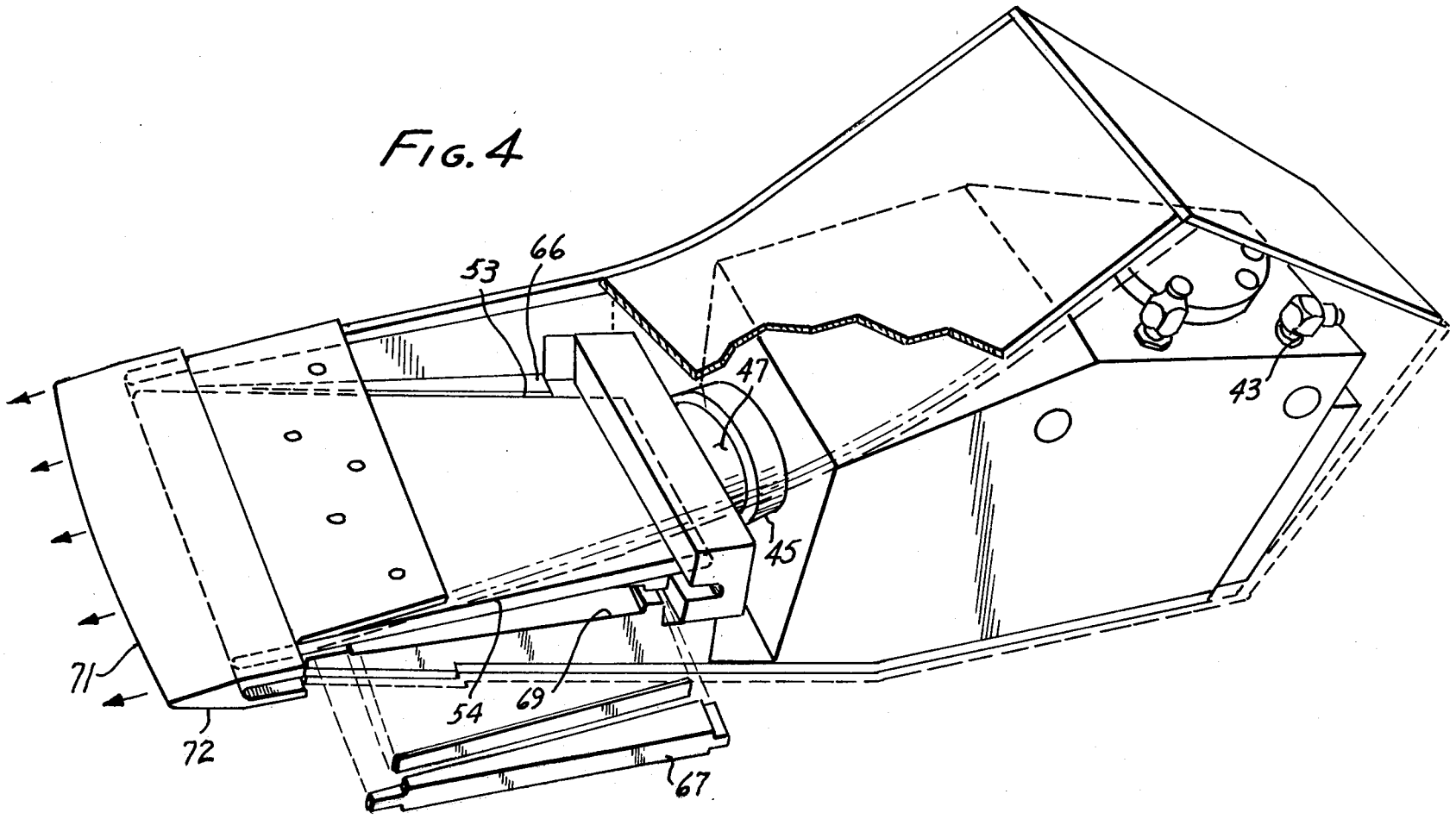
FIG. 4 is a perspective view of the impact hammer of FIG. 1.
Figure 5:
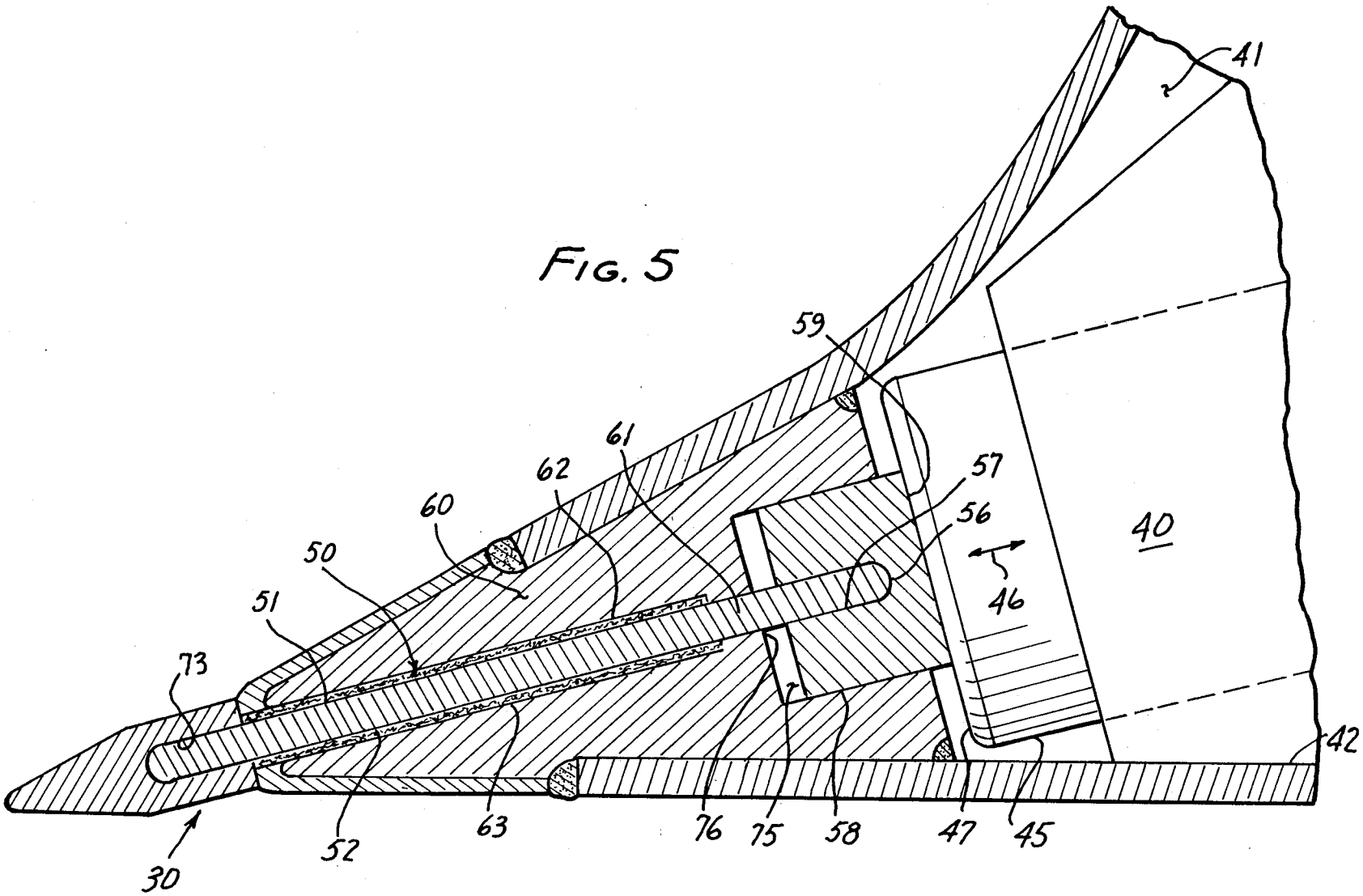
FIG. 5 is an enlarged cross-section view of the impact hammer, in greater detail.

As best shown in FIGS. 4 and 5, the penetration member is confined in a bearing member 60 that is fixed to the bucket. Bearing member 60 has a flat slot 61 in which the blade is fitted. Sheet bearings 62,63 are fitted in the slot contiguous to bearing surface 51 and 52, respectively. These may be organic plastic sheets which reduce the friction. They take surprisingly little wear.

At each edge of the boundary surfaces, the bearing member has a pair of restraint surfaces 65,66, which taper toward each other as they extend away from the digging edge. They are conveniently formed on inserts 66,67 fitted into slots 68,69 in the sides of the bearing member. When the penetration member returns toward the bucket, these tend to align it. When the penetration member is driven, surfaces 53,54 and 65,66 separate from one another so as not to exert a drag on the sides. The contact of the striker keeps the blade aligned after they separate.

Most efficient exertion of impact forces occurs when the impact area is smaller than when larger. This tool presents a long impacting edge. A straight edge, while useful, has serious disadvantages. One is the reduction of force per unit area over the larger area. Another is the possible tendency of the blade to dig in and cant at a sharp edge.

This can be avoided as shown in FIG. 4 by making the edge of the penetration member as a curved edge 71. This can conveniently be provided on a wedge-shaped cover 72 with a slot 73 that receives the free end of the penetration member. Initial contact will be at a reduced length where the edge will deliver a concentrated blow. As the edge is driven into the working face, the contact area grows, but usually fragmentation near the initial contact will facilitate the penetration. Also, the curvature reduces the tendency of the penetration member to cant.

A gap 75 is shown between the striker and face 76 in FIG. 5. The travel of the blade is limited by contact of the striker with face 76, and usually the travel will have stopped before this limit is reached. Limiting retraction of the penetration member is accomplished by a separate stop such as the base of cover 72 or by the impact device itself. Actual retraction of the blade is accomplished by keeping the bucket pressed against the working face.

The flat, plate-like penetration member 30 as shown in FIGS. 1–5 is suitable for most applications of this device. This is because the penetration member generally fragments the face of the body over a width greater than the width of the bucket itself, and the bucket readily enters the fragmented body to collect the materials. However, in some formations the fragmentation is not enough, and the walls of the bucket are confronted by unfragmented material, or material which is not sufficiently fragmented that the bucket walls can readily enter the material to collect it.

Figure 6:
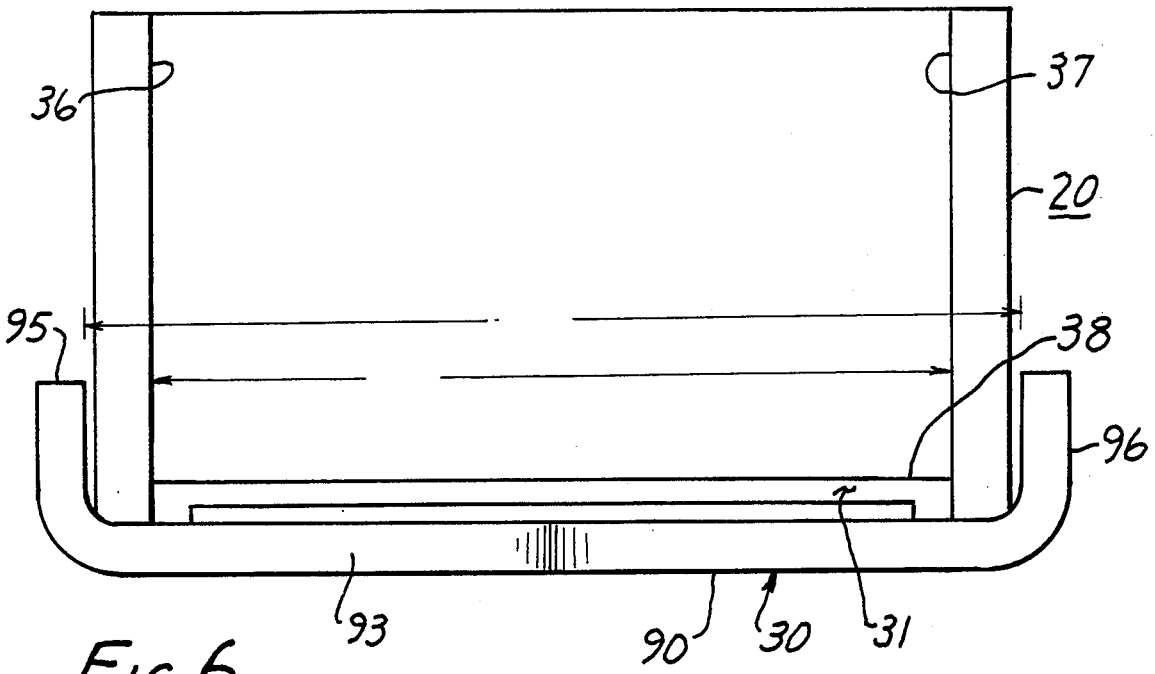
FIG. 6 is a front view showing an improved penetration member.
Figure 7:
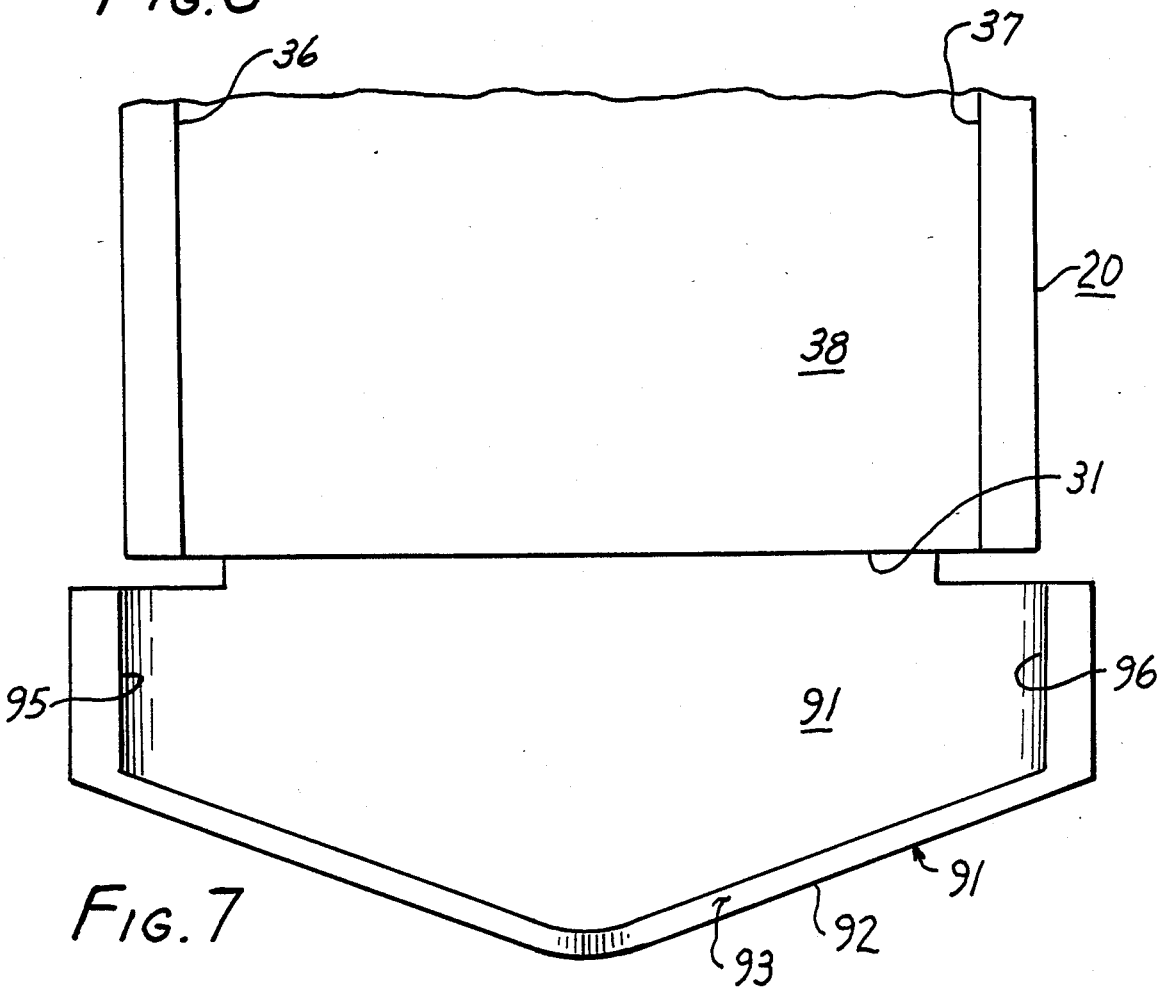
FIG. 7 is a top view of FIG. 6.

This situation is averted by substituting the wedge shaped cover 72 with the winged free edge member 90 shown in FIGS. 6 and 7. While member 90 can be made as a separate and replaceable part, it transpires that it is more readily manufactured as an integral part of the penetration member. Accordingly, corresponding numerals of part from the apparatus shown in FIGS. 1–5 are repeated in FIGS. 6 and 7.

Penetration member 90 has a flat central area 91 with a free edge 92 which is pointed as shown, or curved for purposes described above. In addition, a bevel edge 93 is preferably formed further to reduce the impact area.

Of greater importance are deflector wings 95, 96 which are part of the penetration member, and rise above its central portion. They also are preferably bevelled. As best shown in FIG. 6, they are spaced apart by a distance D which width is larger than the distance E. which is the external width of the bucket. Thus the wings will fragment material to a width greater than the width of the bucket. Also, they will tend to "fold" the fragmented material into the bucket. Accordingly, whatever the nature of the formation, the sides of the the bucket will encounter only a void, or suitably fragmented material so as to minimize the forces that the bucket walls must exert to penetrate and collect the fragmented material.

This device thereby provides a bucket which digs into a working face by virtue of successive impacts that are delivered repetitiously independently of the bucket structure itself. All advantages of bucket operation are provided, together with impact advantages not heretofore attainable.

This invention is not to be limited by the embodiment shown in the drawings and described in the description, which are given by way of example and not of limitation, but only in accordance with the scope of the appended claims.

I claim:

1. A bucket system for release and collection of material on and from a working face, said system comprising:

a bucket having a bottom with a dimension of width, a digging edge, and two sides, said digging edge extending between said sides whereby to form a material receiving structure;

an impact hammer mounted to the bucket beneath said bottom, and including a striker driven percussively and repetitively along an axis which extends generally toward said digging edge;

a penetration member mounted to the bucket beneath said bottom, aligned with said striker to receive blows from it and transmit said blows to said working face, said penetration member having a continuous free edge, extending beyond said digging edge so as to contact said working face before said digging edge makes such contact, and having a dimension of length at least equal to the distance between said two sides at the digging edge, whereby with said impact hammer exerting percussive blows against said penetration member, and with said free edged of said penetration member pressed against said working face, the penetration member fragments said working face over a width at least equal to the distance between the said two sides, and the digging edge follows it so as to collect loosened material in said bucket;

said penetration member including a pair of deflector wings which rise to a level above the bottom of the bucket, and which are spaced farther apart than the sides of the bucket, said wings having a free edge continuous with the free edge in front of the bottom of the bucket.

2. A bucket system according to claim 1 in which said penetration member includes a flat plate portion having a substantial width and a lesser thickness, said plate portion having a pair of opposite planar plate bearing surfaces extending in the direction of impact movement, and support bearing surfaces mounted to the bucket and parallel to the bearing surfaces supporting the plate portions for reciprocable movement along said axis.

3. A bucket system according to claim 2 in which a friction-reducing member forms part of said support bearing surfaces, in contact with said bearing surfaces 4. A bucket system according to claim 3 in which said friction-reducing members are sheets of organic plastic material.

5. A system according to claim 2 in which said penetration member further includes a pair of boundary surfaces extending between said plate bearing surfaces, said boundry surfaces being flat and tapering toward one another as they extend away from said digging edge, and in which a pair of similarly tapered restraint surfaces extend between said support bearing surfaces, whereby the boundary surfaces and restraint surfaces engage each other to align the penetration member at one limit of movement of said plate portion, and separate to free the penetration member from in-plane angular restraint upon movement in the other direction.

6. A system according to claim 1 in which said free edge of said penetration member extending farther from said digging edge at its center than at its edges.

7. A system according to claim 6 in which said free edge is convexly curved.

8. A system according to claim 6 in which said free edge is formed as part of a cover.

9. A system according to claim 1 in which the penetration member includes a plate-like portion and in which a driving base also forms part of said penetration member, receiving said plate-like portion, said driving base having a substantial area facing said striker, said area being normal to said axis.

10. A system according to claim 9 in which said driving base is slidingly fitted into an axially-extending slot, having a non-circular walls so as to resist twisting forces.

11. A system according to claim 1 in which said free edge is bevelled.

* * * * *